US012654212B2

(12) United States Patent
Missal et al.

(10) Patent No.: US 12,654,212 B2
(45) Date of Patent: Jun. 16, 2026

(54) APPARATUS AND METHOD FOR REDUCING THE CROSS SECTION OF A TUBULAR HOLLOW BODY BY SHAPING THE HOLLOW BODY

(71) Applicant: FELSS Systems GmbH, Koenigsbach-Stein (DE)

(72) Inventors: Nadezda Missal, Schwieberdingen (DE); Serjosha Heinrichs, Oberderdingen (DE); Max Olaf Jandt, Keltern (DE); Sascha Voegele, Kaempfelbach (DE)

(73) Assignee: FELSS Systems GmbH, Koenigsbach-Stein (DE)

( * ) Notice: Subject to any disclaimer, the term of this patent is extended or adjusted under 35 U.S.C. 154(b) by 294 days.

(21) Appl. No.: 18/570,123

(22) PCT Filed: Jun. 8, 2022

(86) PCT No.: PCT/EP2022/065524
§ 371 (c)(1),
(2) Date: Dec. 14, 2023

(87) PCT Pub. No.: WO2023/274671
PCT Pub. Date: Jan. 5, 2023

(65) Prior Publication Data

US 2024/0278304 A1 Aug. 22, 2024

(30) Foreign Application Priority Data

Jul. 1, 2021 (EP) ..... 21183206

(51) Int. Cl.
*B21C 1/26* (2006.01)
*B21C 31/00* (2006.01)
(Continued)

(52) U.S. Cl.
CPC ..... *B21C 1/26* (2013.01); *B21C 31/00* (2013.01); *B21C 3/04* (2013.01); *B21C 3/16* (2013.01)

(58) Field of Classification Search
CPC .... B21C 1/26; B21C 3/04; B21C 3/16; B21C 31/00
See application file for complete search history.

(56) References Cited

U.S. PATENT DOCUMENTS 3,596,491 A * 8/1971 Cress ..... B21C 37/16 72/283
4,196,607 A * 4/1980 Youtsey ..... B21C 1/24 72/31.06
(Continued)

FOREIGN PATENT DOCUMENTS

BE 380 771 A 7/1931
BE 700 526 A 12/1967
(Continued)

OTHER PUBLICATIONS

PCT—International Preliminary Report on Patentability of International Application No. PCT/EP2022/065524, Dated Dec. 14, 2023 (with English translation).
(Continued)

*Primary Examiner* — Edward T Tolan
(74) *Attorney, Agent, or Firm* — Collard & Roe, P.C.

(57) ABSTRACT

An apparatus for reducing the cross-section of a tubular hollow body with a hollow body wall has a shaping die on the outer side of the hollow body, a mandrel in the interior of the hollow body, and a shaping drive with a mandrel drive and a die drive. The shaping die is movable by the die drive to reduce a cross-section of the hollow body with an axial movement of the die. The mandrel is movable via the mandrel drive along the hollow body axis through the die opening in the shaping die. The hollow body wall is sub-
(Continued)

Figure 1:
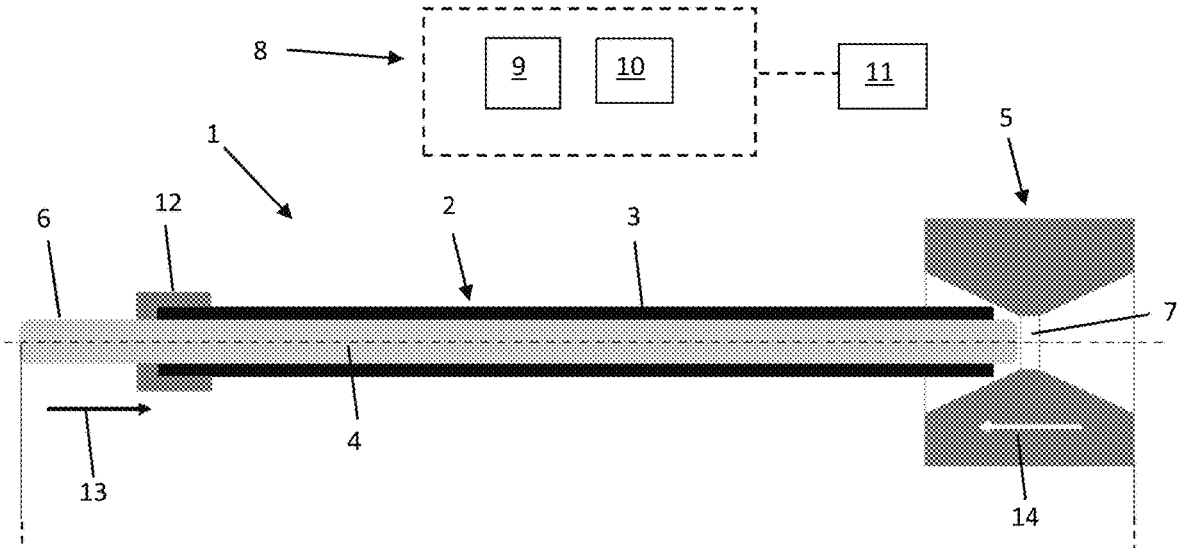

jected to a tensile stress by the mandrel and is drawn in the direction of the axial movement of the mandrel through the die opening. The mandrel drive and the die drive are controlled so that the axial mandrel movement and the axial die movement die are superimposed on one another.

7 Claims, 1 Drawing Sheet

(51) Int. Cl.
*B21C 3/04* (2006.01)
*B21C 3/16* (2006.01)

(56) References Cited

U.S. PATENT DOCUMENTS

| | | | | |
|---|---|---|---|---|
| 4,726,211 | A * | 2/1988 | Sunaga | B21C 1/24 72/283 |
| 5,119,662 | A * | 6/1992 | Sunaga | B21C 1/24 72/283 |
| 6,837,091 | B2 * | 1/2005 | Brochheuser | B21C 1/26 72/283 |
| 7,644,601 | B2 | 1/2010 | Brochheuser et al. | |
| 10,906,077 | B2 * | 2/2021 | Muschalik | B21C 25/04 |
| 12,070,783 | B2 * | 8/2024 | Steinmetz | B21C 37/16 |

FOREIGN PATENT DOCUMENTS

| | | | |
|---|---|---|---|
| EP | 3 175 935 | A1 | 6/2017 |
| GB | 1 104 630 | A | 2/1968 |
| JP | S6420905 | U | 2/1989 |
| JP | 2008520440 | A | 6/2008 |
| KR | 20130041432 | A | 4/2013 |
| WO | 2006/053590 | A1 | 5/2006 |

OTHER PUBLICATIONS

Notification of Transmittal of the International Search Report and the Written Opinion of the International Searching Authority, or the Declaration dated Sep. 6, 2022, with attached International Search Report and Written Opinion of the International Searching Authority in German, with English translation.
Extended European Search Report dated Jan. 25, 2022 in European Application No. 21183206.8 in German, with English translation.
European Office Action dated Jul. 6, 2022 in European Application No. 21183206.8 in German, with English translation.
European Office Action dated Jan. 18, 2023 in European Application No. 21183206.8 in German, with English translation.
Office Action issued in Korean Patent Application No. 10-2024-7003403 mailed on Feb. 19, 2026 (With English Translation).
Decision to Grant Issued in Japanese Patent Application No. JP 2023-580842, mailed on Feb. 24, 2026 (With English Translation).
The Felss Group GmbH, "Axial Forming: The Aximus Generation Machines." (2018).

* cited by examiner

APPARATUS AND METHOD FOR REDUCING THE CROSS SECTION OF A TUBULAR HOLLOW BODY BY SHAPING THE HOLLOW BODY

CROSS REFERENCE TO RELATED APPLICATIONS

This application is the National Stage of PCT/EP2022/065524 filed on Jun. 8, 2022, which claims priority under 35 U.S.C. § 119 of European Application No. 21183206.8 filed on Jul. 1, 2021, the disclosure of which is incorporated by reference. The international application under PCT article 21(2) was not published in English.

The invention relates to an apparatus for reducing the cross-section of a tubular hollow body by shaping the hollow body which has a hollow body wall made of a plastically deformable material and a hollow body axis running in the longitudinal direction of the hollow body,

- having a shaping die which is designed for arranging on the outer side of the hollow body and which has a die opening designed for receiving the hollow body, the die opening having an opening cross-section which is smaller than the hollow body cross-section of the hollow body in an initial state,
- having a mandrel which is designed for arrangement in the interior of the hollow body, and
- having a shaping drive, which has a die drive and a drive controller,
- wherein the shaping die arranged on the outer side of the hollow body is movable with an axial movement of the die along the hollow body axis in a direction of the axial movement of the die relative to the hollow body by means of the die drive with the hollow body cross-section being reduced.

The invention also relates to a method for reducing the cross-section of a tubular hollow body by shaping the hollow body which has a hollow body wall made of a plastically deformable material and a hollow body axis running in the longitudinal direction of the hollow body,

- wherein a shaping die is arranged on the outer side of the hollow body and has a die opening designed for receiving the hollow body the die opening having an opening cross-section which is smaller than the hollow body cross-section of the hollow body in an initial state,
- wherein a mandrel is arranged in the interior of the hollow body, and
- wherein the shaping die arranged on the outer side of the hollow body is moved with an axial movement of the die along the hollow body axis in a direction of the axial movement of the die relative to the hollow body by means of a die drive with the hollow body cross-section being reduced.

Generic prior art is known from practical application. For example, steering shafts designed as hollow shafts for motor vehicles are manufactured by means of the above-mentioned apparatus and by using the above-mentioned method to reduce the cross section of a shaft blank.

In operational practice, an undesired compression of the hollow body to be reduced in its cross-section is observed in a relevant number of cases when using the previously known method and the previously known apparatus. In order to prevent compression of the hollow body, a reinforcement for the hollow body is common in addition to the mandrel and shaping die, which reinforcement surrounds the hollow body on its outer side and supports it in the radial direction.

The object of the present invention is to provide an apparatus and a method that enable a cross-sectional reduction of tubular hollow bodies with minimal design effort, in particular without additional reinforcement of the hollow bodies to be processed, in a functionally reliable manner and with a high-quality processing result.

According to the invention, this object is achieved by the apparatus and the method as described below.

In the case of the invention, the shaping drive has a mandrel drive in addition to the die drive. By means of the die drive, the shaping die arranged on the outer side of the hollow body is actively moved along the hollow body axis with an axial die movement. The undeformed hollow body in an initial state is oversized compared to the opening cross-section of the die opening, i.e. that opening of the shaping die which is designed to produce the reduced hollow body cross-section ("calibration section"). Due to the active movement of the shaping die relative to the hollow body, the hollow body wall acted upon by the shaping die is actively subjected to pressure by the shaping die in the direction of the axial die movement. At the same time, as a result of the axial mandrel movement counter to the axial die movement, the hollow body wall is subjected to tensile stress in the direction of the axial mandrel movement on the side of the impact of the forming die located in the direction of the axial mandrel movement.

The mutual superposition of the active axial mandrel movement and the active axial die movement of the shaping die arranged on the outer side of the hollow body, which is realized by means of the drive controller of the shaping drive according to the invention, is essential to the invention. Due to the superposition of the two mentioned movements, the compressive stresses which build up over the wall cross-section in the hollow body wall due to the impact of the shaping die are at least partially compensated by the tensile stresses in the hollow body wall resulting from the active axial mandrel movement.

Given corresponding, for example empirical, dimensioning and mutual coordination of the pressure load on the hollow body from the shaping die and the tensile stress on the hollow body from the mandrel, undesirable compression of the hollow body wall on the side of the shaping die acting on the hollow body wall located in the direction of axial die movement is reliably prevented, even without additional reinforcement of the hollow body. At the same time, high shaping speeds can be achieved as a result of the superposition of the active die movement and the active mandrel movement.

In general, both the axial mandrel movement and the axial die movement can be controlled both by position and force.

The shaping speed of the apparatus according to the invention and of the method according to the invention is largely independent of the material strength of the hollow body to be shaped. In the case of high-strength materials, relatively high shaping forces are required; at the same time, the tendency of hollow bodies made of high-strength materials to compress is however relatively low. Conversely, tubular hollow bodies made of materials of low strength have a relatively high tendency to compress, but a cross-sectional reduction of such hollow bodies is already possible with relatively low shaping forces.

A cross-sectional reduction in the sense of the invention is to be understood as:

- a reduction exclusively of the cavity cross-section of the hollow body to be shaped (of the inner diameter of the tube in the case of cylindrical tubes) with an unchanged thickness of the hollow body wall, or a reduction exclusively of the thickness of the hollow body wall with an unchanged cavity cross-section of the hollow body, or a reduction in both the hollow space cross-section of the hollow body to be shaped, and the thickness of the hollow body wall.

Particular embodiments of the apparatus and of the method are discussed below.

In a preferred embodiment of the invention, a stationary axial abutment is provided for the hollow body, against which the hollow body is supported in the direction of axial die movement when acted upon by the shaping die.

In the case of the invention, the ratio of the speeds of the axial mandrel movement and the axial die movement of the shaping die arranged on the outer side of the hollow body is set by means of the drive controller of the shaping drive as a function of the ratio of the cross-section of the hollow body in the initial state and the reduced cross-section of the hollow body. Depending on the degree of shaping, the level of the speed of the axial die movement of the shaping die arranged on the outer side of the hollow body can be smaller but also greater than the level of the speed of the axial mandrel movement. In the context of an experimental use of the invention, it was possible to achieve high-quality processing results at a die speed of 30 mm/s to 60 mm/s and a mandrel speed of 21 mm/s to 43 mm/s.

In another embodiment of the invention, it is provided that the ratio of the levels of the axial mandrel movement and the axial die movement during the shaping process is reciprocal to the ratio of the speeds of the axial mandrel movement and the axial die movement during the shaping process. It is thereby ensured that the active mandrel and shaping die movements carried out to shape a hollow body over a shaping length end simultaneously when the shaping length is reached despite different speeds of the mandrel and the shaping die.

In another advantageous embodiment of the invention, the shaping die can be moved by means of the die drive with a positioning movement from a position away from the hollow body to be shaped to a position in which the shaping die is arranged on the outer side of the hollow body, and that by means of the drive controller of the apparatus drive, the die drive and the mandrel drive are controlled in such a way that the mandrel drive initiates the axial mandrel movement before the shaping die impacts the hollow body wall due to the positioning movement. Upon the first contact of the shaping die with the hollow body to be shaped, the mandrel and the hollow body which is driven along the hollow body axis and subjected to tensile stress during the shaping process is thus already in movement. Preferably, the positioning movement of the shaping die is carried out in the direction of the axial die movement.

The speeds of the axial mandrel movement and the positioning movement of the shaping die before the hollow body wall is acted upon by the shaping dies can be significantly higher than the speeds during the shaping process. Accordingly, the possibility exists of moving the mandrel with the hollow body and/or the shaping die in rapid traverse into the position in which the shaping die comes into contact with the hollow body wall for subsequent processing of the hollow body.

Due to the cross-sectional ratios according to the claim an embodiment of the invention is configured for a cross-sectional reduction of the hollow body by reducing the thickness of the hollow body wall.

In a development of the invention, the cross-sectional reduction of the hollow body is accompanied by an additional shaping of the hollow body wall on its outer side and/or on its inner side. At the same time as the cross-sectional reduction, an external toothing and/or an internal toothing of the cross-sectionally reduced hollow body are preferably produced. Additionally or alternatively, the cross-sectional reduction of the hollow body can be connected to the production of a desired outer profile of the hollow body and/or to the production of a desired inner profile of the hollow body.

According to the invention, the movement-related coupling of the mandrel and the hollow body in order to exert tensile stress on the hollow body in the direction of the axial mandrel movement can be carried out in different ways.

It is provided according to the invention that the mandrel exerts tensile stress on the hollow body wall due to a form-fit existing between the mandrel and the hollow body wall. For producing the form-fit, for example the hollow body wall can have a projection projecting into the hollow body interior, on which projection the mandrel is supported with its end leading in the direction of the axial mandrel movement.

In a development of the invention, a force-fit is produced between the mandrel and the hollow body wall of the hollow body to be shaped. Advantageously, the shaping die arranged on the outer side of the hollow body presses the hollow body wall against the mandrel in the radial direction of the hollow body axis. The force-fit between the hollow body wall and the mandrel is accordingly produced at the beginning of the shaping process.

According to the invention, a form-fit and force-fit connection of the hollow body wall to the mandrel executing the axial mandrel movement is also conceivable.

Figure 2:
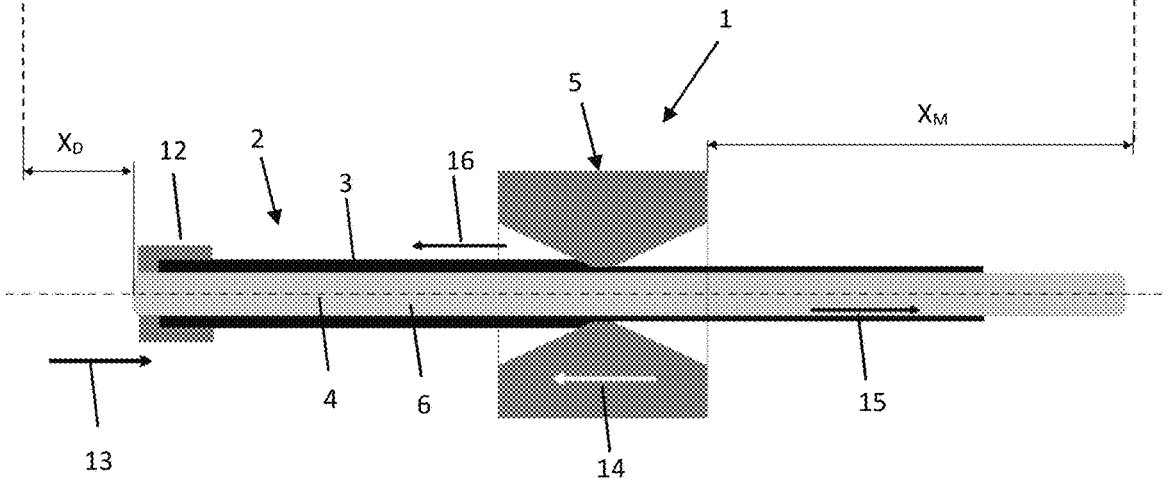

The invention is explained in more detail below by way of exemplary schematic diagrams. In the drawings:

FIG. 1 shows a highly schematic representation of an apparatus for reducing the cross-section of a tube before the start of a shaping process, and FIG. 2 shows the apparatus according to FIG. 1 during the shaping process.

According to FIGS. 1 and 2, an apparatus 1 is used for reducing the cross-section of a tubular hollow body in the form of a cylindrical tube 2. The tube 2 has a tube wall 3 made of a plastically deformable material as the hollow body wall, and a tube axis 4 running in the longitudinal direction of the tube 2 as the hollow body axis.

A steering shaft for a motor vehicle is produced from the tube 2 in a plurality of manufacturing steps.

Within the scope of the manufacturing process, the cross-section of the tube 2, in particular the thickness of the tube wall 3, is reduced by means of the apparatus 1.

For this purpose, the apparatus 1 is installed on an axial shaping machine of conventional design, for example on an axial shaping machine such as is offered by FELSS Systems GmbH, 75203 Königsbach-Stein, Germany, under the product name "Aximus".

The axial shaping machine has a toolholder movable along the tube axis 4 for a shaping die 5, and a mandrel holder, likewise movable along the tube axis 4, for fastening the end of a mandrel 6 remote from the shaping die 5. The toolholder for the shaping die 5 and the mandrel holder are not shown in the figures for the sake of simplicity.

The shaping die 5 is provided with a die opening 7 ("calibration section") designed to reduce the cross-section of the tube 2, the opening cross-section of which is smaller than the cross-section of the tube 2 in the initial state according to FIG. 1.

In the example shown, the die opening 7 is smooth-walled. Alternatively, the die opening 7 can be provided on its circumference with shaping elements, for example with a shaping toothing or with profile-generating elements.

A shaping drive 8 shown in a highly schematic manner in FIG. 1 comprises a mandrel drive 9 and a die drive 10. A numerical drive controller 11 controls not only the mandrel drive 9 but also the die drive 10.

The tube 2 to be shaped is mounted on the axial forming machine with one end on an axial abutment 12 which is stationary along the tube axis 4.

For the cross-sectional reduction of the tube 2, the mandrel 6 is moved by means of the mandrel drive 9 with an axial mandrel movement along the tube axis 4 in the direction of an arrow 13, and the shaping die 5 is moved by means of the die drive 10 with an axial die movement along the tube axis 4 in the direction of an arrow 14.

FIG. 1 shows the situation at the apparatus 1 immediately before the beginning of the cross-section-reducing shaping of the tube 2. In their positions along the tube axis 4, the mandrel 6 has been moved by means of the mandrel drive 9, and the shaping die 5 has been moved by means of the die drive 10 in rapid traverse.

The relatively high feed speeds of the shaping die 5 and of the mandrel 6 at this time are significantly reduced due to a corresponding control of the mandrel drive 9 and the die drive 10 by the drive controller 11 as soon as the die opening 7 of the shaping die 5 reaches the end of the tube 2 located toward the shaping die 5.

The speed reduction of the shaping die 5 and of the mandrel 6 can be controlled both by position or force.

In the example shown, for shaping the tube 2, by means of the drive controller 11 the speed of the axial mandrel movement in the direction of the arrow 13 is set to 15 mm/s, and the speed of the axial die movement of the shaping die 5 in the direction of the arrow 14 is set to 60 mm/s. The axial mandrel movement and the axial die movement are superimposed on each other by means of the drive controller 11.

When the free end of the tube 2 enters the die opening 7, the tube wall 3 is pressed against the mandrel 6 in the relevant region. A force-fit is thereby produced between the tube wall 3 and the mandrel 6.

At the same time, due to the axial die movement in the direction of arrow 14 superimposed on the axial mandrel movement, the tube wall 3 is subjected to pressure by the shaping die 5 on the side of the shaping die 5 located in the direction of arrow 14, and the yield point of the material of the tube wall 3 is thereby exceeded. The axial abutment 12, which supports the tube 2 acted upon by the shaping die 5, is stationary along the tube axis 4 while the tube 2 is being acted upon by the shaping die 5.

As a result of the force-fit between the tube wall 3 and the mandrel 6, the tube wall 3, which is acted upon on the outside by the shaping die 5, is subjected to tensile stress by means of the mandrel 6 in the direction of arrow 13 on the side of the shaping die 5 located in the direction 13 of the axial mandrel movement. The mandrel 6 driven by means of the mandrel drive 9 therefore actively pulls the tube wall 3 in the direction of the arrow 13 through the die opening 7, and the thickness of the tube wall 3 is reduced with simultaneous elongation of the tube 2.

FIG. 2 shows the situation at the apparatus 1 during the ongoing shaping process.

The mandrel 6 applies tensile stress to the tube wall 3 on the side remote from the shaping die 5 in the direction 13 of the axial mandrel movement. The tube wall 3 is subjected to pressure by the shaping die 5. The forces exerted by the shaping die 5 and the mandrel 6 on the tube wall 3 are illustrated in FIG. 2 by arrows 15, 16.

Due to a corresponding matching of the axial mandrel movement in the direction of the arrow 13 and the axial die movement in the direction of the arrow 14, i.e. by corresponding control of the mandrel drive 9 and of the die drive 10, the thickness of the tube wall 3 is reduced without any compression of the tube 2 occurring on the side of the shaping die 5 located in the direction of arrow 14. As a result, in order to prevent compression of the tube 2 in the case of the apparatus 1, there is no need for additional reinforcement on the outside of the tube 2.

With XD, FIG. 2 denotes the path length along which the mandrel 6 has been advanced relative to its position in FIG. 1 in the direction 13 of the axial mandrel movement. Accordingly, $X_M$ in FIG. 2 denotes the length of the travel path of the shaping die 5 starting from the situation according to FIG. 1.

In the example shown, appropriate control of the mandrel drive 9 and of the die drive 10 ensures that the mandrel drive 9 and the die drive 10 can be stopped simultaneously when the desired shaping length is reached on the tube 2.

Due to the fact that an axial mandrel movement and an axial die movement opposite thereto are carried out at the same time, high shaping speeds can be achieved by means of the apparatus 1. Regardless of the high shaping speed, a high-quality processing result is obtained on the tube 2.

The invention claimed is:

1. An apparatus for reducing the cross-section of a tubular hollow body (2) by shaping the hollow body (2) which has a hollow body wall (3) made of a plastically deformable material and a hollow body axis (4) running in the longitudinal direction of the hollow body (2), the apparatus comprising:

a shaping die (5) which is designed for arrangement on an outer side of the hollow body (2) and which has a die opening (7) designed for receiving the hollow body (2), the die opening (7) having an opening cross-section which is smaller than a hollow body cross-section of the hollow body (2) in an initial state, a mandrel (6) which is designed for arrangement in an interior of the hollow body (2), and a shaping drive (8) which has a die drive (10) and a drive controller (11), wherein the shaping die (5) arranged on the outer side of the hollow body (2) is movable with an axial movement of the die along the hollow body axis (4) in a direction (14) of the axial movement of the die relative to the hollow body (2) by means of the die drive (10) with the hollow body cross-section being reduced, wherein the shaping drive (8) has, in addition to the die drive (10), a mandrel drive (9) by means of which the mandrel (6) arranged in the interior of the hollow body (2) can be moved along the hollow body axis (4) through the die opening (7) with an axial mandrel movement directed counter to the axial die movement of the shaping die (5) arranged on the outer side of the hollow body (2), wherein the drive controller (11) of the shaping drive (8), is configured to control the mandrel drive (9) and the die drive (10) in such a way that the axial mandrel movement and the axial die movement of the shaping die (5) arranged on the outer side of the hollow body (2) are superposed on one another, wherein the apparatus is configured such that the mandrel (6) moving in a direction (13) of the axial mandrel movement is effectively supported on the hollow body wall (3) in a force-fit in the direction (13) of the axial mandrel movement such that the mandrel (6) moving in the direction (13) of the axial mandrel movement subjects the hollow body wall (3) to tensile stress in the direction (13) of the axial mandrel movement and the hollow body wall (3) is drawn through the die opening (7) relative to the shaping die (5) arranged on the outside of the hollow body (2) in the direction (13) of the axial mandrel movement.

2. The apparatus according to claim 1, wherein an axial abutment (12) is provided for the hollow body (2), on which the hollow body (2) is supported in the direction (14) of the axial die movement and which is stationary along the hollow body axis (4) during the axial die movement performed by the shaping die (5) arranged on the outside of the hollow body (2) relative to the hollow body (2).

3. The apparatus according to claim 1, wherein the die drive (10) is configured to move the shaping die (5) with a positioning movement from a position away from the hollow body (2) to be shaped to a position in which the shaping die (5) is arranged on the outer side of the hollow body (2), and wherein the drive controller (11) of the shaping drive (8) is configured to control the die drive (10) and the mandrel drive (9) in such a way that the mandrel drive (9) initiates the axial mandrel movement before the shaping die (5) is arranged on the outer side of the hollow body (2) due to the positioning movement of the shaping die (5).

4. The apparatus according claim 1, wherein a common cross-section of the mandrel (6) and the hollow body wall (3) of the hollow body (2) in the initial state is larger than the opening cross-section of the die opening (7) of the shaping die (5).

5. The apparatus according to claim 4, wherein the shaping die (5) is provided with a shaping element, on a circumference of the die opening (7), and/or the mandrel (6) is provided with a shaping element on a circumference of the mandrel.

6. The apparatus according to claim 1, wherein the shaping die (5) arranged on the outside of the hollow body (2) presses the hollow body wall (3) against the mandrel (6) in the radial direction of the hollow body axis (4), such that the mandrel (6) is effectively supported against the hollow body wall (3) in a force-fit in the direction (13) of the axial mandrel movement.

7. A method for reducing the cross-section of a tubular hollow body (2) by shaping the hollow body (2) which has a hollow body wall (3) made of a plastically deformable material and a hollow body axis (4) running in the longitudinal direction of the hollow body (2), wherein a shaping die (5) is arranged on the outer side of the hollow body (2) and has a die opening (7) designed for receiving the hollow body (2) the die opening (7) having an opening cross-section which is smaller than the hollow body cross-section of the hollow body (2) in an initial state, wherein a mandrel (6) is arranged in an interior of the hollow body (2), comprising the steps of:

moving the shaping die (5) arranged on the outer side of the hollow body (2) with an axial movement of the die along the hollow body axis (4) in a direction (14) of the axial movement of the die relative to the hollow body (2) by means of a die drive (10) with the hollow body cross-section being reduced, moving the mandrel (6) arranged inside the hollow body (2) along the hollow body axis (4) through the die opening (7) by means of a mandrel drive (9) provided in addition to the die drive (10) with an axial mandrel movement opposite the axial die movement of the shaping die (5) arranged on the outside of the hollow body (2), controlling the mandrel drive (9) and the die drive (10) in such a way that the axial mandrel movement and the axial die movement of the shaping die (5) arranged on the outside of the hollow body (2) are superimposed on one another, effectively supporting the mandrel (6) moving in a direction (13) of the axial mandrel movement on the hollow body wall (3) in a force-fit in the direction (13) of the axial mandrel movement and subjecting the hollow body wall (3) to tensile stress in a direction (13) of the axial mandrel movement by means of the mandrel (6) moving in the direction (13) of the axial mandrel movement such that the hollow body wall (3) is drawn through the die opening (7) relative to the shaping die (5) arranged on the outside of the hollow body (2) in the direction (13) of the axial mandrel movement.

* * * * *